United States Patent [19]

Arai

[11] 4,338,265

[45] Jul. 6, 1982

[54] ALTITUDE COMPENSATION DEVICE

[75] Inventor: Hisaharu Arai, Nagoya, Japan

[73] Assignee: Aisan Industry Co., Ltd., Aichi, Japan

[21] Appl. No.: 169,700

[22] Filed: Jul. 17, 1980

[30] Foreign Application Priority Data

Aug. 8, 1979 [JP] Japan ..... 54/109102[U]

[51] Int. Cl.[3] ..... F02M 7/24

[52] U.S. Cl. ..... 261/39 A; 261/121 B; 137/81.1; 137/454.5; 251/77

[58] Field of Search ..... 261/39 A, 121 B; 137/81.1, 454.5; 251/77

[56] References Cited

U.S. PATENT DOCUMENTS

| | | | |
|---|---|---|---|
| 2,600,650 | 6/1952 | Hieger | 137/454.5 |
| 2,631,024 | 3/1953 | Beardsley, Jr. | 261/39 A |
| 2,737,873 | 3/1956 | Bell | 137/81.1 |
| 3,310,069 | 3/1967 | Hoffman | 251/77 |
| 3,859,397 | 1/1975 | Tryon | 261/39 A |
| 3,872,189 | 3/1975 | Brown et al. | 261/39 A |
| 3,985,836 | 10/1976 | Fischer | 261/39 A |
| 3,987,131 | 10/1976 | Hisatomi et al. | 261/39 A |
| 4,105,043 | 8/1978 | Nicolayczik | 137/454.5 |
| 4,153,652 | 5/1979 | Ogita | 261/39 A |
| 4,181,108 | 1/1980 | Bellicardi | 261/121 B |
| 4,217,314 | 8/1980 | Dysarz | 261/121 B |
| 4,276,237 | 6/1981 | Barker | 137/81.1 |

*Primary Examiner*—Tim R. Miles

[57] ABSTRACT

An altitude compensation device for automobile engines or the like having a bellows adapted to detect the altitude and a plurality of valve mechanisms adapted to be actuated by the expansion or contraction of the bellows to adjust respective compensation air. The device has a disc mounted in the body of the device for free up and downward movement keeping a horizontal posture. The disc is carried by the bellows making a point contact with the central portion of the upper face of the bellows, so that it is almost free from the tilting of the bellows attributable to a vibration or the like. The valve mechanisms are operatively supported by the disc so as to be actuated uniformly by the bellows through the medium of the disc. Also, means are provided for adjusting the valve mechanisms independently of one another.

7 Claims, 1 Drawing Figure

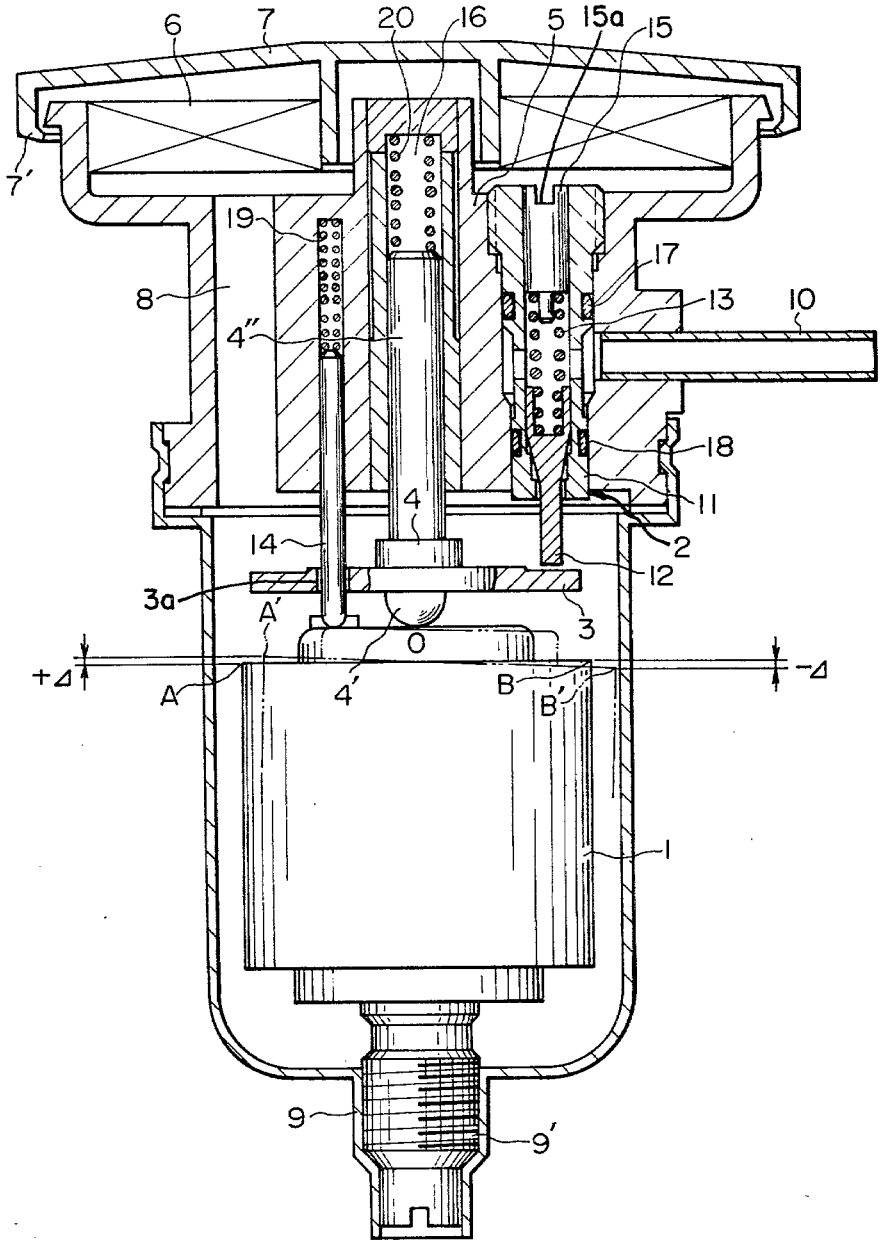
6
7
20
16
5
15a
15
7'
19
17
8
13
10
4''
18
4
11
14
2
12
3a
A'
3
O
+Δ
-Δ
A
4'
B
B'
1
9
9'

ALTITUDE COMPENSATION DEVICE

BACKGROUND OF THE INVENTION

The present invention relates to an altitude compensation device for compensating for a change of air-fuel ratio of mixture supplied to an engine caused by a change in the altitude.

The density of air in the mixture sucked by the engine varies as the atmospheric pressure is changed, so that the air-fuel ratio of the mixture is undesirably changed to cause various inconveniences such as reduction of power, increase of noxious components and so forth.

Therefore, there has been proposed and actually used an altitude compensation device which compensates for the change of air-fuel ratio atributable to the change of atmospheric pressure due to a change in altitude.

In the conventional altitude compensation device, it is necessary to control a plurality of valves by a single altitude compensation device. For instance, in case of a 2-barrel 2-stage carburetor, it is necessary to provide compensation for the slow system, main system (first main jet, second main jet and power jet), vacuum for angle advancer of the distributor and so forth. It has, therefore, been attempted to provide a plurality of valves in contact with an end of a bellows so that these valves may be operated by a common bellows. However, such a bellows cannot be made perfectly free from vibration, and is usually subjected to the vibration caused by the engine, vibration of the chassis and so forth to cause oscillation or rocking up and down and to the left and right. The valves on the bellows are moved up and down as the bellows rocks and rolls. Thus, as the bellows is tilted, some of the valves are operated while the others are not, so that the altitude compensation device as a whole cannot perform the expected operation.

SUMMARY OF THE INVENTION

Under this circumstance, the present invention aims as its major object to provide an altitude compensation device which can eliminate the above-described shortcomings of the prior art.

To this end, according to the invention, there is provided an altitude compensation device comprising a disc mounted in said body and adapted to be moved up and down maintaining a horizontal disposition, said disc being mounted on said bellows making a point contact with a central portion of an upper face of said bellows, said valve mechanisms being engaged at the ends thereof on the upper surface of said disc so that said valve mechanisms are simultaneously operated by the up and down movements of said disc, each of said valve mechanisms having a valve seat telescopically and adjustably screwed into said body and a pin operating as a spring retainer, said pin being formed with a driver groove at an upper end thereof and being press-fitted to be formed integrally with the valve seat of said valve mechanism.

The above and other objects, as well as advantageous features of the invention will become clear from the following description of the preferred embodiment taken in conjunction with the accompanying drawings.

BRIEF DESCRIPTION OF THE DRAWINGS

The attached sole FIGURE is a longitudinal sectional view of an altitude compensation device in accordance with the present invention.

DESCRIPTION OF THE PREFERRED EMBODIMENT

Referring to the drawings, an altitude compensation device of the invention has a bellows 1 and a plurality of valve mechanisms 2 including valves 12. These valves 12 are held in contact with the bellows 1 via a top-like disc 3. The disc 3 has a shaft 4 thereon and the lower end of which is formed as a spherical portion 4'. The upper journal portion 4'' of the shaft 4 is fitted into a body 5 for free vertical sliding movement. The clearance between the journal 4'' and the body 5 is diminished as much as possible to precisely guide the vertical movement of the disc 3. The disc 3 is constituted by a disc-shaped member which is installed so as to have a major plane perpendicular to the axis of the shaft 4, and operatively supports the aforementioned plurality of valves 12. An air filter 6 disposed above the body 5 is a laminated type filter having a density gradient, and is formed to have a doughnut-like shape, and is interposed and clamped between the main body 5 and filter cap 7. For facilitating the renewal of the filter 6, the filter cap 7 is provided with a peripheral convexity 7' adapted to snap-fit to a corresponding recess formed in the main body 5.

The main body 5 is provided with an air passage 8 which is adapted to transmit the air to the bellows side. The bellows is held by a cover 9 with the aid of screws 9' in an adjustable manner. The cover 9 in turn is secured at its upper portion to the body 5 by a press-fit or caulking.

The altitude compensation device thus constructed is mounted on the engine through a bracket and is connected to an associated control part through a hose 10.

As will be seen from the drawing, a valve mechanism 2 is constituted by a valve seat 11, valve member 12 and a spring 13. The flow rate of the compensation air is determined by the taper of the valve member 12. Reference numeral 14 denotes a rotation stopper which extends through a recess or opening **3*a* formed in the disc 3 for preventing the rotation of the disc 3. Adjusting pin 15 is a retainer for the spring 13, which pin 15 is press-fitted into and so as to be formed integrally with the valve seat 11, and which pin 15 is also formed with a driver groove 15*a* so as to be able to turn the valve seat 11, the latter being formed as a screw screwed into the main body 5 so as to be able to adjustably be moved up and down relative thereto. The arrangement is such that, as the adjusting pin 15 is rotated by means of a screwdriver engaging the screwdriver groove 15*a* formed therein, the adjusting pin 15 is moved up and down along with the valve seat 11 to change the timing of contact between the valve member 12 and the disc 3**.

A reference numeral 16 denotes an air chamber, while "O" rings are designated at reference numerals 17 and 18. Numerals 19 and 20 denote springs disposed in respective bores in the body 5 biasing the rotation stopper 14 and the shaft 4 in a direction toward the disc 3 respectively.

The altitude compensation device of the invention having the described construction operates in a manner described hereinunder.

The intake air cleaned by the air filter 6 is delivered to the bellows 1. The bellows 1 makes an expansion or contraction by atmosphere and drives the valve 12 through the disc 13 by a stroke in accordance with the atmospheric pressure. If the diameter of the journal 4'' and the diameter of the bore formed in the body 5 for receiving the journal 4'' are formed at suitable tolerances, and if the bore is closed at its upper end, the air confined in the bore provides a damping effect which effectively suppresses the vibration of the disc 3. The disc 3 makes a point contact with the center of the bellows 1 at the spherical portion 4', the vertical movement of the disc caused by a lateral swinging or rocking of the bellows is minimized and all valve members 12 are uniformly moved vertically by the disc. As a result, each valve passes the compensation air at a rate determined by the opening degree of the valve member 12 and the taper formed on the latter.

The chain line A'B' in the drawings shows the tilted position of the bellows which normally takes an upright position represented by a line A,B. Supposing here that each valve mechanism was directly supported by the bellows, the valve mechanism positioned at the right side end of the bellows as viewed in the drawing would be displaced by $-\Delta$, whereas the valve mechanism positioned at the left side end would be displaced by $+\Delta$, as a result of the tilting of the bellows irrespective of the atmospheric pressure. Thus, the valve mechanisms would be erroneously operated even when there is no change in the atmospheric pressure. To the contrary, the center 0 of the bellows makes almost no displacement, so that the displacement of the disc, which is carried by the center of the bellows, is minimized against the tilting of the bellows attributable to the vibration of the same.

As has been described, according to the invention, a change in the atmospheric pressure appears as a uniform displacement of the valve members 12 of all valve mechanisms, because these valve members are actuated by a dommon disc 3 which is carried by the bellows 1. In addition, it is possible to adjust the valve mechanisms independently of one another. In addition, the levelness of the upper face of the bellows need not be so high, because the valve mechanisms 2 are not carried directly by the bellows. Further, since the disc 3 makes a point contact with the center of the upper face of the bellows 1, operation of the valve mechanisms are not so much affected by tilting of the bellows attributable to vibration of the same.

What is claimed is:

1. In an altitude compensation device comprising a body, a bellows in said body adapted for detecting the altitude, and a plurality of valve mechanisms actuated in accordance with an expansion or contraction of said bellows to adjust compensation air, the improvement comprising a disc mounted in said body and adapted to be moved up and down maintaining a horizontal disposition, said disc being mounted on said bellows making a point contact with the center of an upper face of said bellows, said valve mechanisms each having an operative valve member being engaged at free ends thereof on an upper surface of said disc so that said valve mechanisms are simultaneously operated by the up and down movements of said disc, each of said valve mechanisms having a valve seat adjustably screwed into said body and a pin acting as a spring retainer, said valve seat being formed with a flow opening, a spring engaging between said pin and said valve member, the latter being displaceably mounted in said flow opening in said valve seat and cooperatively for opening and closing said flow opening depending on the up and down movements of said disc, said pin being formed with a screwdriver groove at an upper end thereof and being press-fitted to be formed integrally with the valve seat of said valve mechanism.

2. The device according to claim 1, wherein said valve seat has a constricted central portion formed with a radial opening radially therethrough operatively communicating with said flow opening, said body is formed with a bore parallel to the axis of said disc and formed with an upper threaded portion, said valve seat has an upper threaded portion threadedly mounted, axially adjustably in said bore, in said upper threaded portion of said bore and forms an annular opening between said bore and said constricted portion communicating with said radial opening, a hose extends into said body and transversely communicates with said annular opening, O-rings are mounted between said bore and said valve seat above and below said annular opening.

3. The device according to claim 1, wherein said disc is formed with a peripheral edge recessed slightly thinner than the remainder of said disc, said valve members at said free ends thereof operatively engage said peripheral edge of said disc.

4. The device according to claim 1, wherein said body is formed with a centrally located bore, a shaft is connected centrally to said disc and with snug clearance but is freely vertically displaceably mounted in said bore of said body, spring means mounted in said bore for biasing the free end of said shaft in a direction toward said bellows.

5. The device according to claim 4, wherein said shaft extends below said disc into a spherical portion engaging the center of said upper face of said bellows constituting said point contact, said upper face of said bellows is a flat disc.

6. The device according to claim 1, wherein said disc is formed with a recess, a spring biased rotation stopper pin is mounted in said body and extends through said recess in said disc, thereby preventing rotation of said disc.

7. The device according to claim 6, wherein said body is formed with a bore spaced parallel to the axis of said disc, said recess extends completely through said disc and is aligned with said bore, said rotation stopper pin is disposed in said bore and extends completely through said recess in said disc and has a free end engaging a peripheral edge of said upper face of said bellows, spring means disposed in said bore for biasing said rotation stopper pin such that said free end of said rotation stopper pin abuts said peripheral edge of said upper face of said bellows.

* * * * *